United States Patent [19]

Scales

[11] 3,967,458

[45] July 6, 1976

[54] MARINE APPARATUS HAVING TELESCOPIC LEGS

[75] Inventor: Ralph E. Scales, Beaumont, Tex.

[73] Assignee: Bethlehem Steel Corporation, Bethlehem, Pa.

[22] Filed: Nov. 14, 1974

[21] Appl. No.: 523,934

[52] U.S. Cl. ..... 61/46.5; 254/105

[51] Int. Cl.[2] ..... E02B 17/00

[58] Field of Search ..... 61/46.5, 46; 254/105, 254/106, 107, 108, 109, 110

[56] References Cited

UNITED STATES PATENTS

| | | | |
|---|---|---|---|
| 2,908,142 | 10/1959 | Suderow | 61/46.5 |
| 2,956,525 | 10/1960 | Blauvelt | 109/59 |
| 2,961,837 | 11/1960 | Suderow | 61/46.5 |
| 2,979,911 | 4/1961 | Sutton | 61/46.5 |
| 2,984,075 | 5/1961 | Suderow | 61/46.5 |
| 3,082,607 | 3/1963 | Sutton | 61/46.5 |
| 3,411,750 | 11/1968 | Smulders | 254/110 |
| 3,495,806 | 2/1970 | Sutton | 254/107 |

*Primary Examiner*—Dennis L. Taylor
*Attorney, Agent, or Firm*—Joseph J. O'Keefe; Michael J. Delaney

[57] ABSTRACT

A mobile marine apparatus has a platform, telescopic legs for supporting the platform, each telescopic leg having at least one inner section slidably mounted within an outer section, a frame member attached to the lower ends of the outer sections, a mat attached to the lower ends of the inner sections, locking means to selectively restrain relative movement between the sections and a jacking mechanism on the platform for selectively effecting or restraining relative movement between the platform and the sections and between the sections.

26 Claims, 14 Drawing Figures

22
28
28
23
18
24
10
15
47
36
20
47
36
15
31
30
30
31
12
31
30
30
31

13
31
94
47
47
35
36
31
13
94
47
35
36

31
35
11
35
31
31
30
32
11
32
31
32
32
32
31
30
13
47
47
36
47
47
36
35
36
16
35
36
34
14
33
33
34
35
35
33
34
34
33
14
17
72

FIG. 7
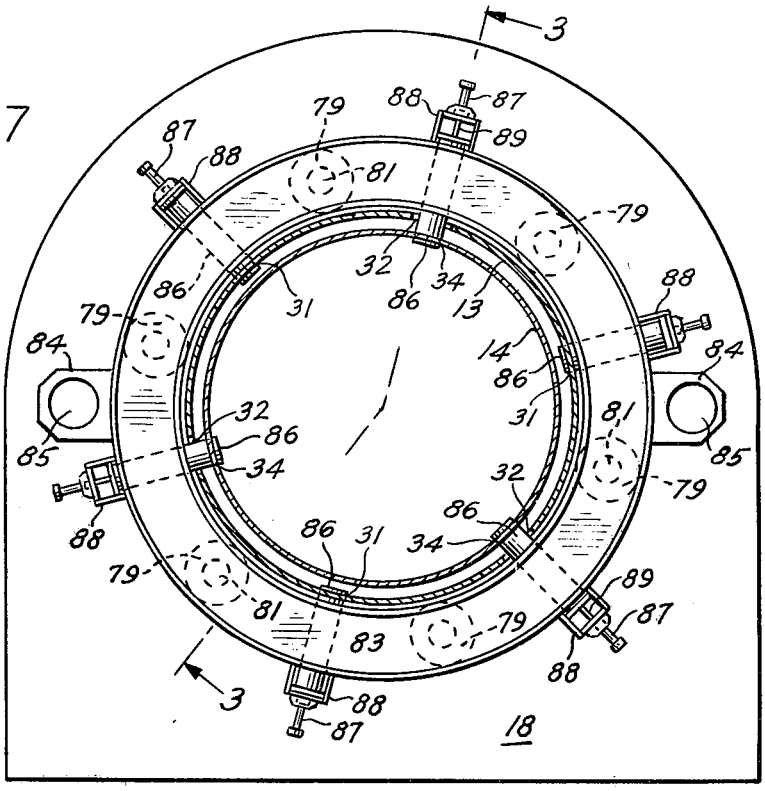
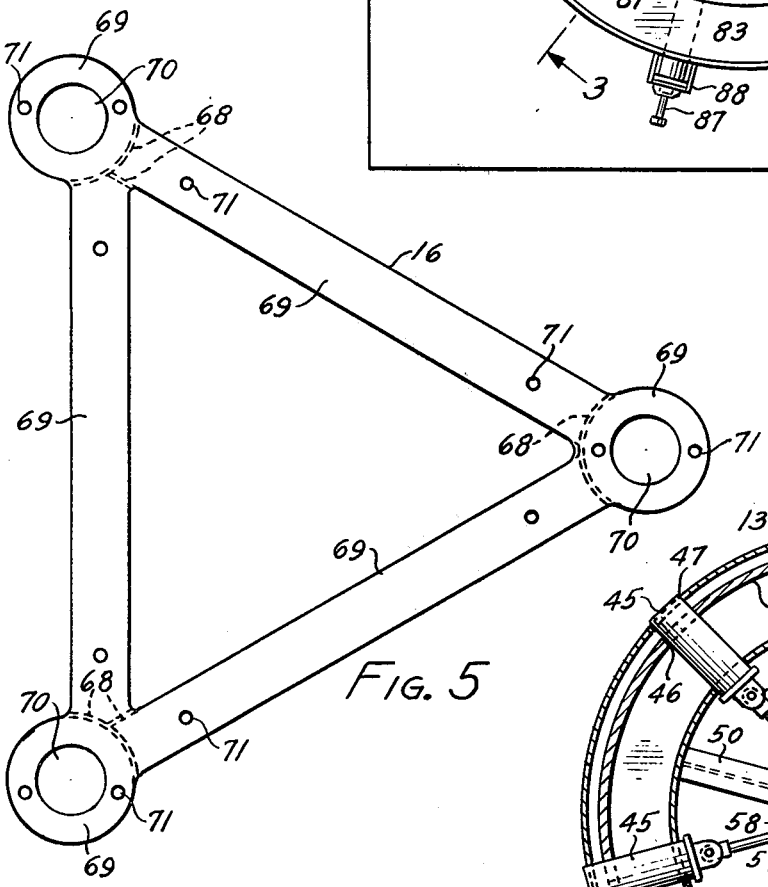
FIG. 5
FIG. 6
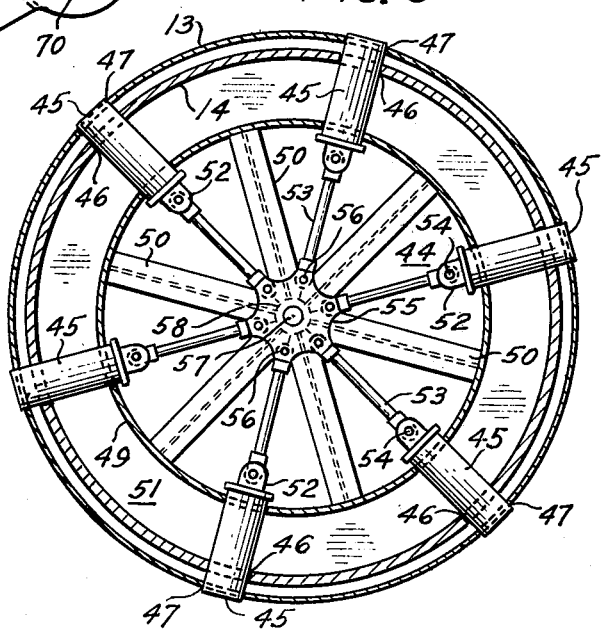

MARINE APPARATUS HAVING TELESCOPIC LEGS

Background of the Invention

Present day mobile marine apparatus of the jack-up type include a plurality of legs which extend through openings in a platform. The legs consist of a plurality of sections fixedly joined together. Each leg is designed to contact the bottom of a body of water and support the platform during drilling or a similar operation. Thus, each leg must have a length at least as great as the depth of water in which the platform is to operate.

Generally, when such apparatus is to be moved a considerable distance, it is desirable to remove as much of the legs as possible from the water due to the resistance to movement created by the portions of the legs which are in the water. However, when a considerable length of leg extends above the platform, the stability of the apparatus may be adversely affected, especially in rough waters.

Furthermore, as the length of a leg is increased to allow a marine apparatus to operate in deeper water, some structural changes must be made to provide a leg having the proper rigidity. Such changes may include an increase in the cross sectional area of the leg and/or the addition of brace members to the leg. Increasing the cross sectional area and/or the adding of brace members necessitates an increase in the size and lifting capacity of the jacking mechanism which supports and moves the leg.

A way of increasing the effective length of a leg, and thus increasing the depth of the water in which a mobile marine apparatus of the above type can be used is to provide legs which comprise leg sections which telescope. By so doing, substantially the entire length of a leg can be removed from the water when the apparatus is to be moved without adversely affecting the stability of the apparatus. U.S. Pat. Nos. 2,908,142 (1959); 2,948,120 (1960); 2,961,837 (1961); 2,984,075 (1961); and 3,007,317 (1961), all issued to Suderow, disclose marine apparatus including a platform adapted to be supported on legs which comprise telescopic leg sections.

SUMMARY OF THE INVENTION

This invention is directed to an improved marine apparatus which utilizes telescopic legs for supporting the platform of such apparatus.

An object of this invention is to provide a mobile marine apparatus having telescopic legs and adapted to operate in a wide range of water depths.

A further object of this invention is to provide a mobile marine apparatus which utilizes an improved jacking mechanism for extending and retracting sections of a telescopic leg for supporting such apparatus.

The above objects can be accomplished by providing a mobile marine apparatus comprising a platform, a plurality of telescopic legs for supporting the platform with each leg including an outer section and at least one inner section slidably mounted within the outer section, a frame member attached to the lower ends of each outer section, locking means carried by one of the sections selectively engageable with the other section for restraining relative movement between the sections, and a jacking mechanism mounted on the platform for selectively effecting or restraining relative movement between the platform and the sections and between the sections.

BRIEF DESCRIPTION OF THE DRAWINGS

FIG. 5 is a plan view of the frame member which connects the lower ends of the outer sections of the telescopic legs.

FIG. 6 is a view taken along the line 6—6 of FIG. 3.

FIG. 7 is a view taken along the line 7—7 of FIG. 3.

DETAILED DESCRIPTION OF THE DRAWINGS

Figure 1:
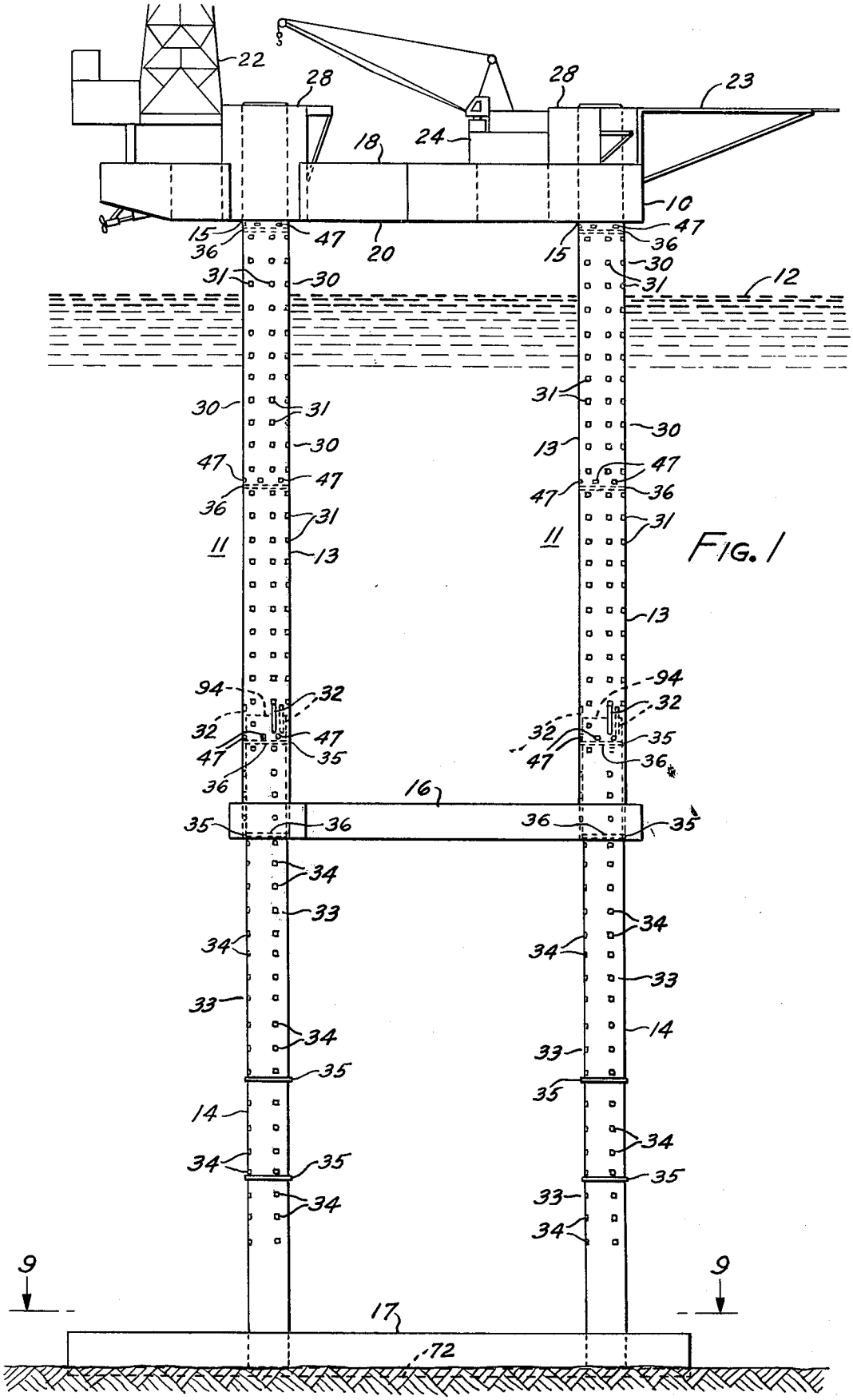
FIG. 1 is an elevational view of the apparatus of this invention showing the telescopic legs in a fully extended position.

As best shown in FIG. 1 the apparatus of this invention comprises a platform 10, a plurality of substantially vertically extending telescopic legs 11 for supporting the platform 10 above a body of water 12, each leg 11 includes an outer section 13 and an inner section 14 slidably mounted within the outer section 13, guide means including openings 15 in the platform 10 for receiving the outer sections 13 of each telescopic leg 11, a frame member 16 attached to the lower ends of each outer section 13 and a mat 17 attached to the lower ends of each inner section 14.

Platform

Figure 3:
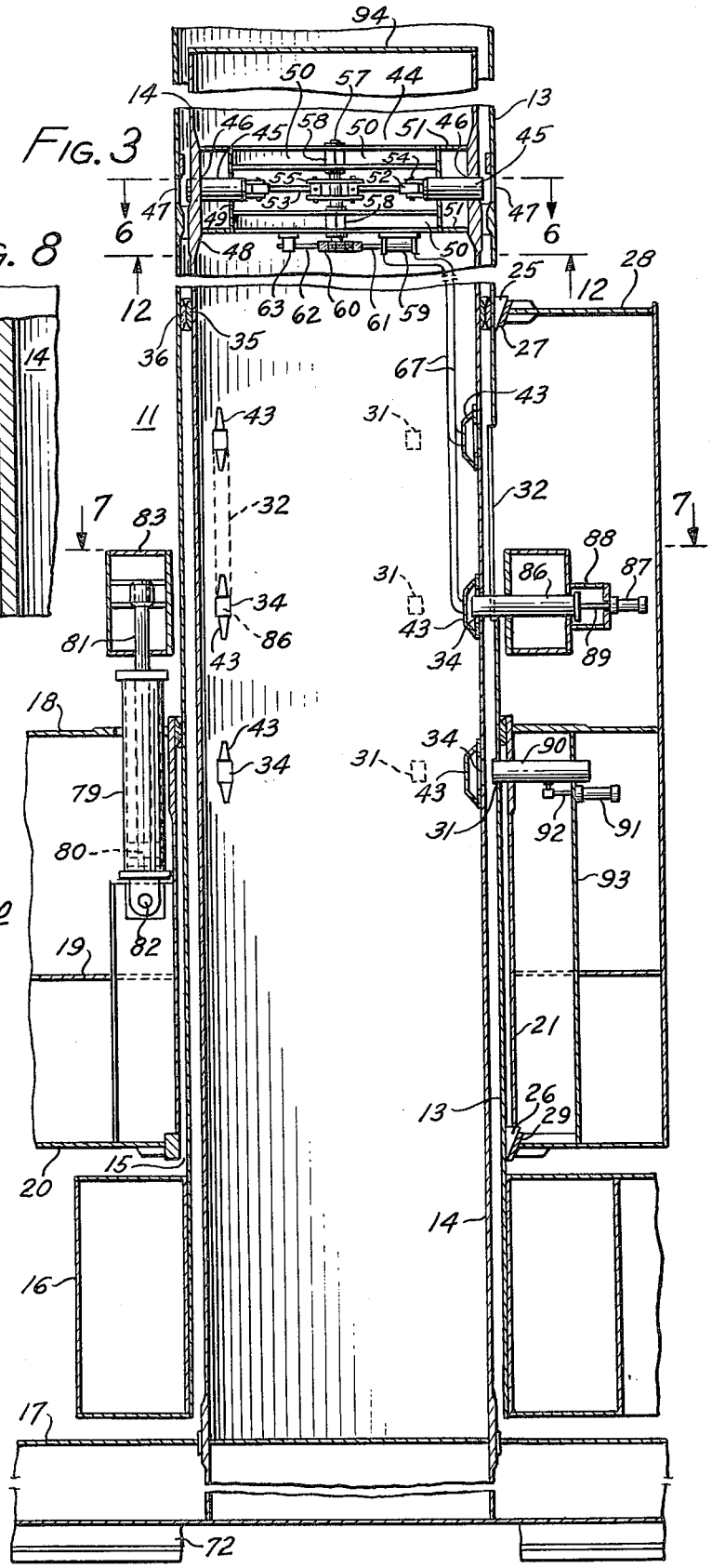
FIG. 3 is a partial cross sectional view of the apparatus of this invention, taken along the line 3—3 of FIG. 7 and showing the jacking mechanism for a telescopic leg which is in a fully retracted position.

As best shown in FIG. 3 the platform 10 includes an upper deck 18, an intermediate deck 19 and a lower deck 20. Vertically extending, circular plate 21 fixed to the upper, intermediate and lower decks 18, 19 and 20, respectively, forms opening 15 for guiding a telescopic leg 11. Such an opening 15 in the platform is provided for each telescopic leg 11.

Referring to FIG. 1 the platform 10 may have a derrick 22, a helicopter landing deck 23, and a deck house 24 mounted thereon.

Referring to FIG. 3, upper wedges 25 and lower wedges 26 are provided. These wedges 25, 26 when in operating position, are in contact with outer section 13 of the telescopic leg 11 with the upper wedge 25 in contact with ring 27 attached to the top of yoke house 28 and the lower wedge 26 in contact with ring 29 attached to lower deck 20. During movement of the legs 11 the wedges 25, 26 are withdrawn from contact with the outer section 13 by means not shown.

Telescopic Legs

Figures 2, 14:
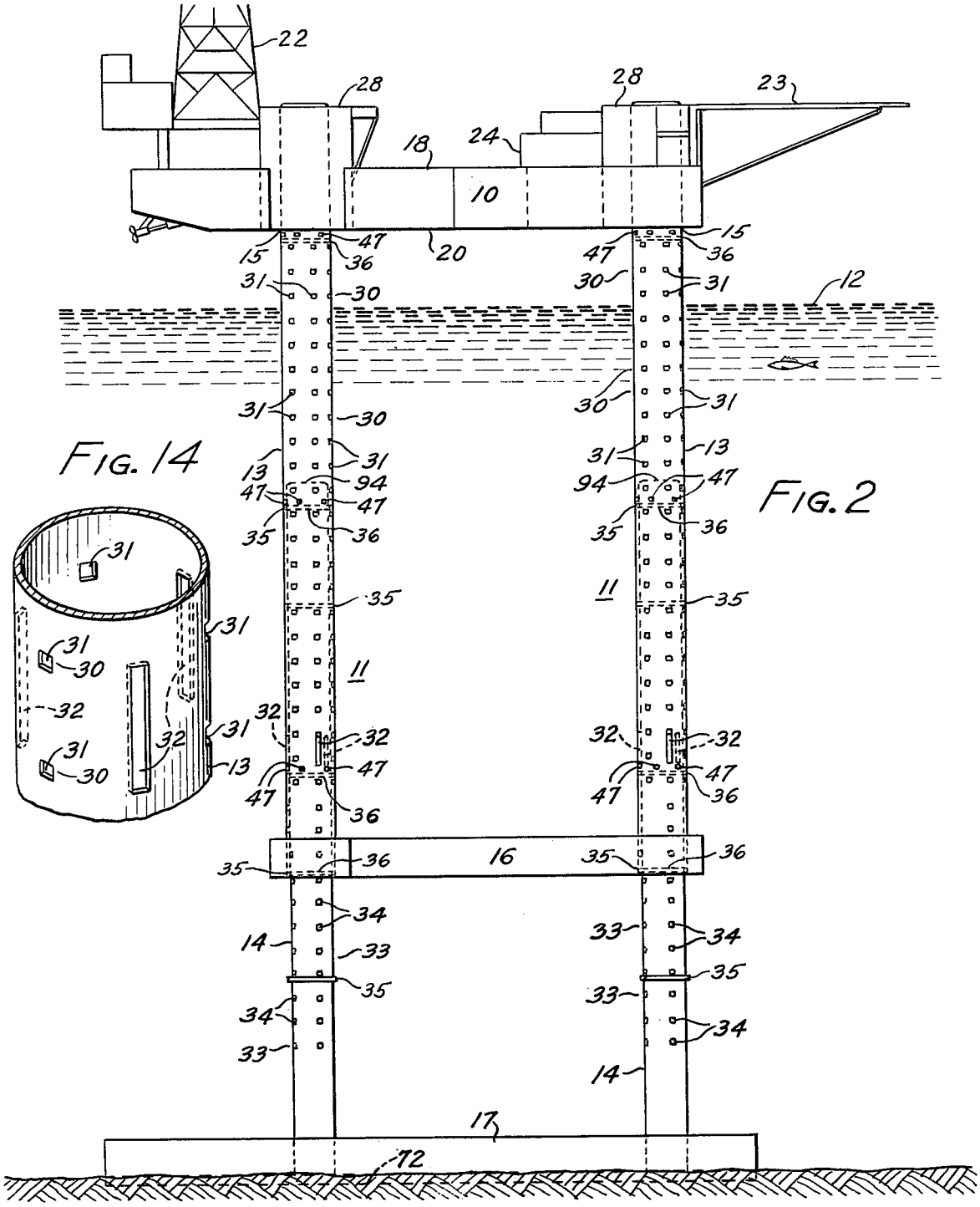
FIG. 2 is an elevational view of the apparatus of this invention showing the telescopic legs in a partially extended position.
FIG. 14 is an enlarged perspective view of a portion of the outer section of a leg.

Referring to FIG. 2 each telescopic leg 11 comprises an outer section 13 and an inner section 14 slidably mounted within outer section 13. As shown, the sections 13, 14 are cylindrical in shape, however, other shapes may be used. Inner section 14 has its lower end fixed to mat 17 while outer section 13 has its lower end fixed to frame member 16. Outer section 13 has a plurality of vertically spaced rows 30 of openings 31 equally spaced about the circumference of the outer section 13. The outer section 13 has six openings 31 in each row 30. In addition to such openings 31 the outer section 13 includes, as shown in FIG. 14, three vertically extending slots 32 equally spaced about the circumference of the outer section 13. The inner section 14 also includes a plurality of vertically spaced rows 33 of openings 34 equally spaced about the circumference of inner section 14. The inner section 14 has three openings 34 in each row 33.

Figure 4:
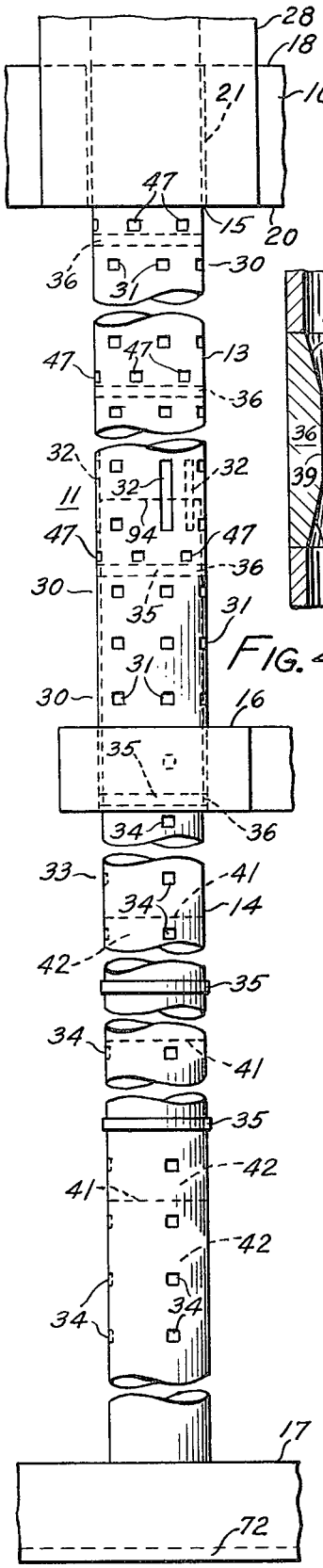
FIG. 4 is an elevational view, partly broken, showing specific details of one telescopic leg relative to the platform, mat and frame member.
Figure 8:
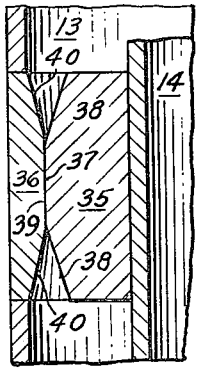
FIG. 8 is an enlarged cross sectional view of the bearing members of the inner and outer sections of a telescopic leg.

As best seen in FIGS. 3 and 4 there are a number of bearing members consisting of rings 35 fixed to the outer surface of the inner section 14 of a telescopic leg 11. There are also a number of similar bearing members consisting of bearing rings 36 fixed to the inner surface of the outer section 13. These bearing members are positioned such that two bearing members 35 of the inner section 14 are in contact with two bearing members 36 of the outer section 13 when the telescopic legs 11 are in the fully retracted position shown in FIG. 3, in the fully extended position shown in FIG. 1, and in an intermediate position shown in FIG. 2. As shown in FIG. 8 each bearing ring 35 of inner section 14 has a flat vertically extending surface 37 and upper and lower tapered surfaces 38. Each bearing ring 36 of outer section 13 has a flat vertically extending surface 39 and upper and lower tapered surfaces 40. Such tapered surfaces 38, 40 facilitate movement of the sections relative to each other, while the flat vertically extending surfaces 37, 39, when in contact with each other, provide lateral stability to the telescopic leg 11.

As best shown in FIG. 4, the lower end of inner section 14 of telescopic leg 11 includes three water tight plates 41 to form permanently buoyant compartments 42. As shown in FIG. 3 the openings 34 in inner section 14 below the uppermost water tight plate 41 of FIG. 4 are provided with water tight interior covers 43 in order to prevent water from entering compartments 42.

Referring to FIGS. 3, 6, 12 and 13, a locking means 44 is attached to the upper end of inner section 14 which has a cover plate 94 thereon. The locking means 44 allows the inner and outer section 14, 13 to be releasably locked together to restrain relative movement therebetween.

The locking means 44 comprises six locking pins 45 which extend through openings 46 in inner section 14 and selectively extend into openings 47 in outer section 13. As shown in FIG. 1, outer section 13 has openings 47 at three locations along its length in order to allow the length of a leg 11 to be varied as seen by comparing such length in FIGS. 1 and 2. Obviously, openings 47 in outer section 13 could be provided at more or less than such three locations. Referring to FIGS. 3, 6, 12 and 13, the locking pins 45 are in sliding contact with a reinforced section 48 of inner section 14 and circular plate 49. Attached to circular plate 49 and extending inwardly therefrom are six upper and six lower structural members 50. Extending between and attached to the structural members 50 and reinforced section 48 are upper and lower annular plates 51. The inner end of each locking pin 45 includes a clevis portion 52 which is pivotally attached to connecting rod 53 by pin 54. The connecting rod 53 is also pivotally connected to spoke member 55 by means of a pin 56. Spoke member 55 is fixed to vertically extending shaft 57 rotatably mounted in bearings 58 secured to structural members 50.

Figure 13:
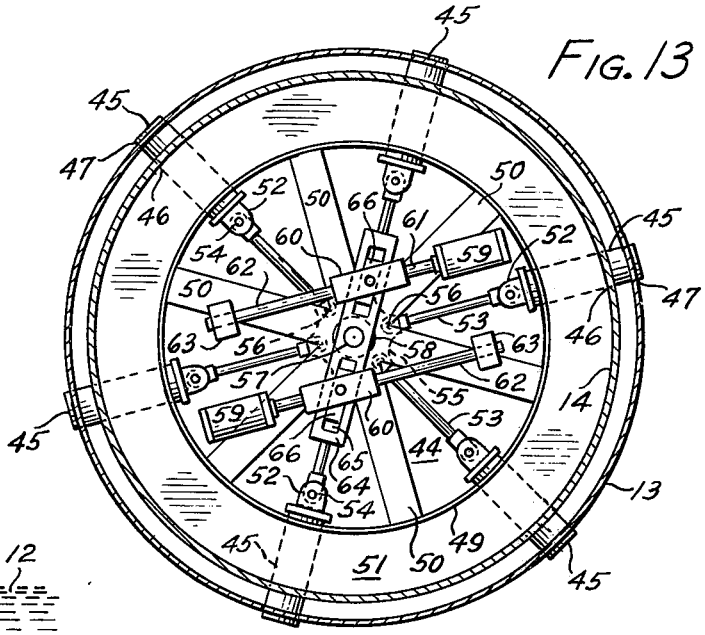
FIG. 13 is a view similar to FIG. 12 showing the locking means in engagement with the outer section.
Figure 12:
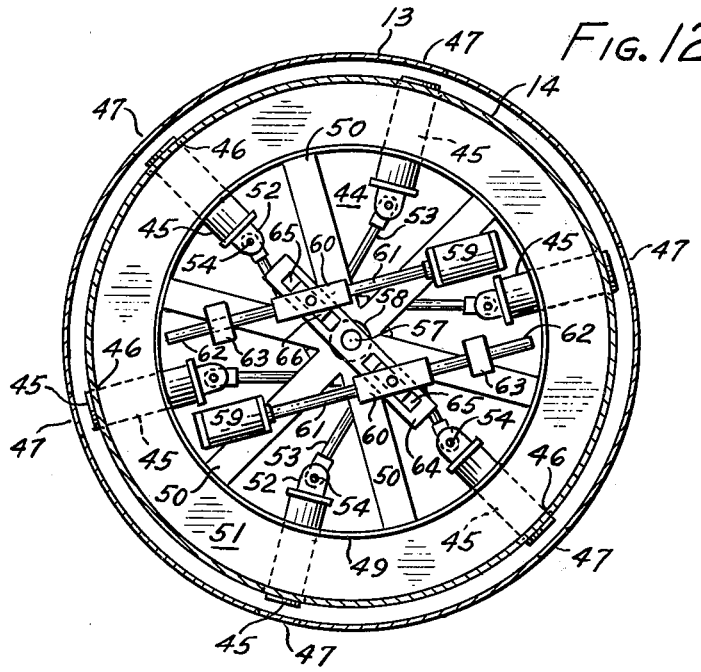
FIG. 12 is a view taken along the line 12— of FIG. 3 showing the locking means out of engagement with the outer section.

Referring to FIGS. 12 and 13, a pair of hydraulic cylinders 59 are attached to the bottom side of a structural member 50 and on opposite sides of shaft 57. Keeper blocks 60 are attached to one end of each piston rod 61 of cylinder 59 and the other end of the keeper blocks 60 are attached to guide rods 62 which are slidably mounted in guide blocks 63 attached to a structural member 50. Attached to the lower end of shaft 57 is a cross head 64 which includes a pair of slot 65 for receiving slideblocks 66 which are pivotally attached to keeper blocks 60. Thus by extending and retracting the piston rods 61 of cylinders 59 slide blocks 66 cause crosshead 64 and shaft 57 to rotate in unison. Rotation of shaft 57 causes spoke member 55 to rotate and through connecting rod 53 move locking pins 45 between the position shown in FIG. 13 wherein the locking pins 45 extend into the openings 47 in outer section 13 and the position shown in FIG. 12 wherein the locking pins 45 are retracted from the openings 47 in outer section 13.

As shown in FIG. 3, hydraulic pressure is supplied to cylinders 59 through hydraulic lines 67 which extend from the cylinders 59 through the covers 43 of a few of the openings 34 in inner section 14. Proper hydraulic fittings (not shown) are applied to the ends of the hydraulic lines 67 which extend through such covers 43 so that such fittings may be releasably connected to a source of hydraulic pressure (not shown). Access to such fittings is attained through openings 31 of outer section 13.

Frame Member

Referring to FIG. 5 the lower end of each outer section 13 of each telescopic leg extends into openings 70 in frame member 16 and is attached thereto. The frame member 16 is of box girder construction and provides bracing between the telescopic legs 11 and lateral stability to the marine apparatus. The frame member is subdivided by water-tight bulkheads 68 to form permanently buoyant compartments 69 therein. Watertight manhole covers 71 allow access to compartments 69.

Mat

Figure 9:
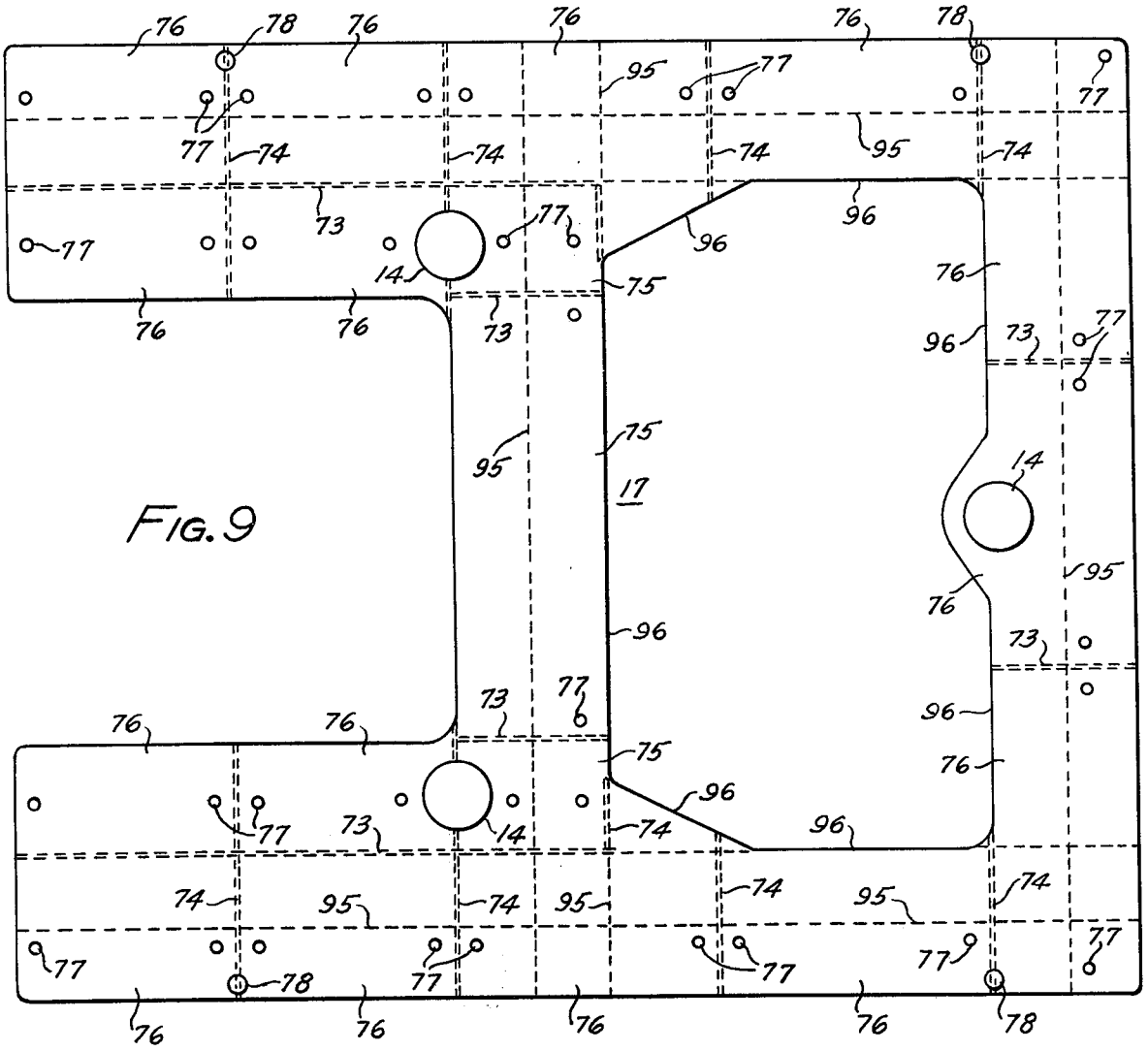
FIG. 9 is a view taken along the line 9—9 of FIG. 1.
Figure 10:
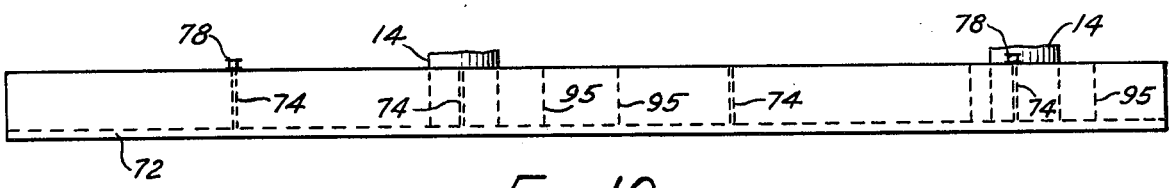
FIG. 10 is an elevational view of FIG. 9.

As shown in FIGS. 9 and 10, the mat 17 comprises a substantially A-shaped buoyant barge-like structure. Extending downwardly from the entire outer perimeter of mat 17 and from the inner sides 96 of the mat 17 is an integral skirt 72. When the marine apparatus of this invention is in operating position, the mat 17 rests on the marine bottom and acts as a base for the marine apparatus. The friction between the bottom of the mat 17 and the marine bottom and the horizontal pressure on the sides of the mat 17 including the skirt 72 allow the mat 17 to resist any tendency for lateral movement thereof.

The mat is subdivided by watertight longitudinal and transverse bulkheads, 73 and 74, respectively, into permanently buoyant compartments 75 and permanently flooded compartments 76. The permanently buoyant compartments 75 in the mat 17, in conjunction with the buoyancy compartments 42 of the lower end of the inner section 14 of the telescopic legs 11, provide sufficient buoyancy to support most of the weight of the mat 17, the telescopic legs 11 and the frame member 16. Watertight manhole covers 77 provide access to the various compartments in the mat 17. Mooring chocks 78 are attached to and extend upwardly from mat 17. Other non-watertight bulkheads 95 further subdivide the mat and provide rigidity to it.

The permanently flooded compartments 76 remain flooded when the apparatus of this invention is in an operating position, i.e. the mat 17 is on the marine bottom and the platform is elevated above the surface of the water, and when the apparatus is being moved from one location to another. The flooded compartments 76 can be deballasted by means of piping (not shown) when the apparatus is in the position shown in FIG. 3. By so doing the draft of the platform 10 can be reduced and, if desired, the apparatus can be floated on the mat 17.

Jacking Mechanism

Referring to FIGS. 3 and 7, the jacking mechanism includes six power-actuated hydraulic cylinders 79 equally, circumferentially spaced about the circumference of each telescopic leg 11. Each such power-actuated hydraulic cylinder 79 comprises a piston 80 and a piston rod 81. The lower end of each cylinder 79 is pivotally attached to the platform 10 by means of pin 82. Extending upwardly from each cylinder 79 is its piston rod 81 which is attached to a circular yoke 83 which encircles outer section 13 of the telescopic leg 11. Each yoke 83 has a pair of integral, outwardly projecting ears 84 which include openings therein for sliding engagement with yoke guide columns 85 fixed to platform 10. Upper holding means comprising six upper pins 86 is carried by and equally spaced about each yoke 83. Each pin is moved horizontally by piston rod 89 of pin cylinder 87 which is attached to frame 88. Thus the upper holding means including the six upper pins 86 within yoke 83 may be moved vertically by means of power-actuated cylinders 79 and horizontally moved by means of pin cylinders 87.

Mounted below the upper deck 18 and above intermediate deck 19 of platform 10 is a lower holding means including six vertically fixed lower pins 90 which are equally, circumferentially spaced about opening 15 for each telescopic leg 11. Each pin 90 is capable of horizontal movement by means of pin cylinder 91 which is attached to plate 93 and has its piston rod 92 attached to pin 90.

Operation

The apparatus is floated to an operating site with the members positioned as shown in FIG. 3. Thereafter, the following steps take place in lowering the inner sections 14 of the telescopic legs from their position shown in FIG. 3 to the position shown in FIG. 11:

1. With the upper and lower wedges 25, 26 moved out of engagement with outer section 13, all six vertically fixed lower pins 90 are positioned through the openings 31 in the outer section 13 of the telescopic leg 11. Three of such pins 90 extend into the openings 34 of the inner section 14. Thus, the inner and outer sections 14, 13 are supported on the lower pins 90.

2. All six of the upper pins 86 are moved by pin cylinders 87 horizontally outwardly from engagement with openings 31, 34 in the outer and inner sections 14, 13, respectively of the telescopic leg 11.

3. Cylinders 79 are operated to extend piston rod 81 and raise yoke 83 substantially the full stroke of cylinder 79 until upper pins 86 are aligned with a row of openings 34 in inner section 14.

4. The three upper pins 86 that are aligned with the three vertical slots 32 are moved inwardly to pass through openings 34 in the inner section 14.

5. Cylinders 79 are operated to raise yoke 83 a short distance and transfer the weight of the inner section 14 and mat 17 from the three lower pins 90 that are in engagement with openings 34 to the three upper pins 86 that engage openings 34 in inner section 14.

6. The three lower pins 90 which are in the openings 34 of the inner section 14 are moved outwardly from engagement with such openings 34 by means of pin cylinders 91.

7. Pressure is removed from the lower end of cylinder 79 and applied to the upper end thereof to move the inner section 14 downwardly with respect to the outer section 13 a distance substantially equal to the stroke of the cylinder 79 until the three lower pins 90 are aligned with openings 34 in the inner section 14. The three lower pins 90 that are so aligned are moved inwardly to pass through such openings 34 in the inner section 14.

8. Cylinder 79 is operated to further lower the yoke 83 a short distance to transfer the weight of the inner section 14 and mat 17 from the three upper pins 86 to the three lower pins 90.

9. The three upper pins 86 are withdrawn from the openings 34 in the inner section 14 and the yoke 83 raised as set forth in step 3 above. Thereafter the above steps 4, 5, 6, 7, 8, and 9 are repeated until the locking pins 45 of locking means 44 are aligned with the desired locking pin openings 47 in outer section 13. When such alignment takes place cylinders 59 are actuated to cause shaft 57 and spoke member 55 to rotate and through connecting rod 53 moves pins 45 outwardly to engage locking pin openings 47 in outer section 13.

At this point in the operation, the inner section 14 has been lowered the desired amount and locking means 44 has been actuated so that locking pins 45 restrain vertical movement between the sections 13, 14. In addition, surfaces 37 of two bearing members 35 of inner section 14 are in contact with surfaces 39 of two bearing members 36 of outer section 13. Such contact of the bearing member 35, 36 provide lateral stability to a leg 11.

Figure 11:
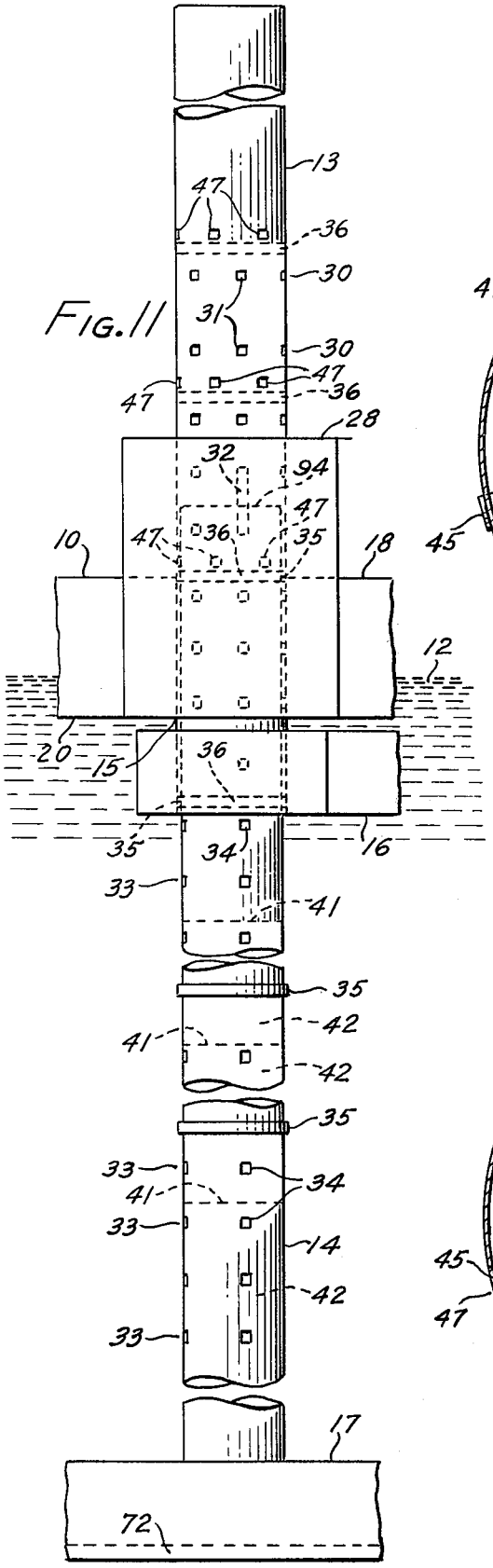
FIG. 11 is an elevational view of the apparatus of this invention, partly broken, showing the platform afloat and the inner section of a leg extended downwardly from the platform while the outer section of a leg extends upwardly from the platform.

The following steps take place in lowering the outer section 13 from the position shown in FIG. 11 to the position shown in FIG. 1 and then raising the platform 10 above the surface of the water 12:

**1*a*. With the six lower pins 90 engaging the openings 31 in the outer section 13 and the upper pins 86 retracted from such engagement, cylinder 79 is operated to extend piston rod 81 and raise yoke 83 substantially the full stroke of cylinder 79 until the three upper pins 86, which are not aligned with a slot 32, are aligned with openings 31 in the outer section 13. Upon such alignment, such three pins 86 are moved horizontally inwardly by means of pin cylinders 87 to pass through the openings 31 in the outer section 13**.

2*a*. Cylinder 79 is operated to raise yoke 83 a short distance to transfer the weight of the leg 11, mat 17 and frame member 16 from the lower pins 90 to the three upper pins 86. The six lower pins 90 are then moved out of engagement with the openings 31 in the outer section 13.

3*a*. Pressure is removed from the lower end of cylinder 79 and is applied to the upper end thereof to move the outer section 13 and inner section 14 downwardly relative to the platform 10 a distance about equal to the stroke of the cylinder 79 until the lower pins 90 are aligned with openings 31 in the outer section 13. Upon such alignment, the lower pins 90 are moved inwardly by pin cylinders 91 to pass through the openings 31 in the outer section 13.

4*a*. Cylinder 79 is operated to further lower the yoke 83 a short distance to transfer the weight of the leg 11, mat 17 and frame member 16 from the upper pins 86 to the lower pins 90.

5*a*. The upper pins 86 are then withdrawn from the openings 31 in the outer section 13, the yoke 83 is raised and above steps 1*a*, 2*a*, 3*a*, 4*a* and 5*a* are repeated. However, in so repeating such steps it is possible to engaged six upper pins 86 in openings 31 in the outer section 13, if desired, since slots 32 will be at an elevation lower than the upper holding means of the jacking mechanism. After repeating such steps the required number of times depending on the length of the legs 11 and the depth of water 12, the mat contacts the marine bottom and thereafter the platform 10 is elevated the desired distance above the surface of the water 12. Upon reaching such an elevation, upper and lower wedges 25, 26 are placed in contact with outer section 13 to provide lateral stability to the platform 10. The apparatus is now in position to perform the desired operation.

The following steps take place in lowering the platform 10 from the position shown in FIG. 1 to the position shown in FIG. 11 and, thereafter, raising the outer section 13 to the position shown in FIG. 11.

1*c*. With the upper and lower wedges 25, 26 moved out of engagement with outer section 13, all six lower pins 90 are positioned through the openings 31 in outer section 13 of the of the telescopic leg 11. All six upper pins are moved outwardly from engagement with the openings 31 in outer section 13.

2*c*. Cylinders 79 are operated to retract piston rod 81 and lower yoke 83 substantially the full stroke of cylinder 79 until upper pins 86 are aligned with a row of openings 31 in outer section 13.

3*c*. The upper pins 86 are moved inwardly to pass through the aligned openings 31 in outer section 13.

4*c*. Cylinders 79 are operated to raise yoke 83 a short distance and transfer the weight of the platform 10 from the lower pins 90 to the upper pins 86.

5*c*. Lower pins 90 are moved outwardly from engagement with openings 31 by means of pin cylinders 91.

6*c*. Pressure is removed from the upper end of cylinder 79 and applied to the lower end thereof to allow the platform to move downwardly relative to the outer section 13 a distance substantially equal to the stroke of cylinder 79 until the lower pins 90 are aligned with openings 31 in outer section 13. The lower pins 90 are then moved inwardly to pass through such openings 31.

7*c*. Cylinder 79 is operated to further lower the yoke 83 a short distance to transfer the weight of the platform from the upper pins 86 to the lower pins 90.

8*c*. The upper pins 86 are withdrawn from openings 31 in outer section 13, and the yoke 83 is lowered as set forth in step 2c above. Thereafter above steps 3c, 4c, 5c, 6c, 7c and 8c are repeated. During such repetition of steps, the platform 10 will be lowered into the water 12 and the outer section 13 raised relative to the platform 10, as shown in FIG. 11.

The following steps take place in raising the innersection 14 from the position shown in FIG. 11 to the position shown in FIG. 3.

1*d*. All of the lower pins 90 extend through openings 31 in the outer section 13 and three of such pins 90 also extend through openings 34 in inner section. Thus the inner section 14 and outer section 13 are supported on the lower pins 90. Thereafter, cylinders 59 of locking means 44 are actuated to move pins 45 out of engagement with locking pins openings 47 in outer section 13.

2*d*. All six of the upper pins 86 are moved by pin cylinders 87 horizontally outwardly from engagement with openings 31 in outer section 13.

3*d*. Cylinders 79 are operated to lower yoke 83 substantially the full stroke of cylinder 79 until upper pins 86 are aligned with a row of openings in inner section 14.

4*d*. The three upper pins 86 that are aligned with the three vertical slots 32 of outer section 13 are moved inwardly to pass through openings 34 in inner section 14.

5*d*. Cylinders 79 are operated to raise the yoke 83 a short distance and transfer the weight of the inner section 14 and mat 17 from the three lower pins 90 that are in engagement with openings 34 to the three upper pins 86 that engage openings 34 in inner section 14.

6*d*. The three lower pins 90 which are in openings 34 of inner section 14 are moved outwardly from engagement with such openings 34 by means of pin cylinders 91.

7*d*. Pressure is removed from the upper end of cylinder 79 and applied to the lower end thereof to raise yoke 83 and inner section 14 a distance substantially equal to the stroke of the cylinder 79 until the three lower pins 90 are aligned with the openings 34 in the inner section 14. Such three lower pins are moved inwardly to pass through such openings in the inner section 14.

8*d*. Cylinder 79 is operated to lower the yoke 83 a short distance to transfer the weight of the inner section 14 and mat 17 from the three upper pins 86 to the lower pins 90.

9*d*. Thereafter the above steps 2*d*, 3*d*, 4*d*, 5*d*, 6*d*, 7*d* and 8*d* are repeated until the inner section 14 is positioned as shown in FIG. 3.

It will be readily apparent, in view of the above, that the above described telescopic leg and jacking mechanism could be used to effect or restrain relative vertical movement between the platform and a section of telescopic leg and between sections of a telescopic leg wherein such telescopic leg includes more than one inner section. In such case, in addition to the outer section having slots 32, as described above, all sections except the innermost section would be provided with such slots. In addition locking means, as described above, would be provided to releaseably restrain movement between adjacent sections of the telescopic leg.

I claim:

1. Marine apparatus comprising a. a platform, b. a plurality of telescopic legs for supporting said platform, each leg including an inner section slidably mounted within an outer section, c. guide means on said platform mounting each outer section for substantially vertical movement in either direction relative to said platform, d. a frame member attached to the lowe ends of each outer section, e. locking means carried by one of said sections and releasably engageable with the other section for restraining relative, substantially vertical movement therebetween in either direction, and f. jacking mechanism mounted solely on said platform and including vertically spaced and relatively vertically movable upper and lower holding means selectively engageable with said outer section and with said inner section for selectively effecting or restraining relative, substantially vertical movement in either direction between said platform and said sections and between said sections.

2. The apparatus of claim 1 further comprising a mat attached to the lower ends of each inner section.

3. The apparatus of claim 2 wherein said mat is divided by bulkheads into buoyant and non-buoyant compartments.

4. The apparatus of claim 1 wherein said frame member includes a buoyant compartment.

5. The apparatus of claim 1 wherein each of said inner sections includes a pair of vertically spaced bulkheads to provide a buoyant chamber therein.

6. The apparatus of claim 1 wherein said upper and lower holding means comprise pin means for releasably engaging substantially horizontal, vertically spaced surfaces on said sections.

7. The apparauts of claim 6 wherein said platform includes an upper and lower deck, said guide means comprises an opening extending through said platform, said lower handling means is positioned below said upper deck, and said upper holding means is positioned above said upper deck.

8. The apparatus of claim 1 wherein the locking means is carried by the upper end of said inner section.

9. The apparatus of claim 8 wherein the locking means comprises a plurality of horizontally spaced locking pins mounted within and extending through said inner section for releasably engaging substantially horizontal, vertically spaced surfaces on said outer section.

10. The apparatus of claim 9 wherein each of said locking pins are pivotally connected to a connecting rod which is pivotally connected to a spoke member means to rotate said spoke member about a vertical axis to effect substantially horizontal movement of said locking pins.

11. The apparatus of claim 1 wherein each outer section includes two inwardly extending first bearing members secured to the inner surface of each outer section for engagement with two outwardly extending second bearing members secured to the outer surface of each inner section to provide lateral stability to said leg when said leg is supporting said platform.

12. Marine apparatus comprising a. a platform, b. a plurality of substantially vertically extending telescopic legs for supporting said platform, each leg including an inner section slidably mounted within an outer section, c. locking means carried by one of said sections and releasably engageable with the other section for restraining relative, substantially vertical movement therebetween in either direction, d. a frame member attached to the lower ends of each outer section, and e. jacking mechanism mounted solely on said platform including vertically spaced and relatively vertically movable upper and lower holding means selectively engageable with said outer section and with said inner section through openings in said outer section and power-actuated means for effecting relative vertical movement in either direction between said upper and lower holding means for selectively effecting or restraining relative, substantially vertical movement in either direction between said platform and said sections and between said sections.

13. In a marine apparatus including a platform and a plurality of telescopic legs for supporting said platform, each of said legs including an inner section slidably mounted within an outer section, the improvement comprising a. a jacking mechanism mounted solely on said platform for selectively effecting or restraining relative, substantially vertical movement in either direction between said platform and said sections and between said sections and including upper and lower holding means, b. power actuated means for effecting relative vertical movement in either direction between said upper and lower holding means, and c. openings in said outer section to allow said upper and lower holding means to pass therethrough and engage said inner section to effect substantially vertical movement of said inner section within said outer section.

14. The apparatus of claim 13 further comprising locking means carried by one of said sections and releasably engageable with the other section for restraining relative substantially vertical movement therebetween in either direction.

15. The apparatus of claim 14 wherein one of said upper and lower holding means is vertically fixed relative to the platform and the other of said upper and lower holding means is verticaly movable relative to the platform.

16. The apparatus of claim 15 wherein a portion of said openings of subparagraph (c) for said other of said upper and lower holding means are elongated slots.

17. The apparatus of claim 16 wherein a frame member is attached to the lower ends of each outer section.

18. The apparatus of claim 17 wherein a mat is attached to the lower ends of each inner section.

19. The apparatus of claim 18 wherein said mat is divided by bulkheads into buoyant and non-buoyant compartments.

20. The apparatus of claim 19 wherein said frame member includes a buoyant compartment therein.

21. The apparatus of claim 20 wherein each of said inner sections includes a pair of vertically spaced transverse bulkheads which provide a buoyant chamber therein.

22. The apparatus of claim 21 wherein each outer section includes an inwardly extending first bearing member secured to the inner surface of said outer section for engagement with an outwardly extending second bearing member secured to the outer surface of said inner section to provide lateral stability to said leg when said leg is supporting said platform.

23. In a marine apparatus including a platform and a plurality of telescopic legs for supporting said platfrom, each of said legs including at least one inner section slidably mounted within an outer section, the improvement comprising a. a jacking mechanism mounted solely on said platform for selectively effecting or restraining relative, substantially vertical movement in either direction between said platform and said sections and between said sections and including upper and lower holding means, b. said lower holding means vertically fixed relative to said platform and said upper holding means vertically movable relative to said platform, c. power actuated means for effecting vertical movement of siad upper holding means, d. first elongated openings in said outer section to allow said upper holding means to pass through said outer section, engage said inner section when said leg is in a retracted position and effect movement of said inner section relative to said outer section, and e. second openings in said outer section to allow said lower holding means to pass through said outer section and engage said inner section.

24. The apparatus of claim 23 wherein a frame member is attached to the lower ends of each outer section.

25. The apparatus of claim 24 wherein each outer section includes two inwardly extending first bearing member secured to the inner surface of each outer section for engagement with two outwardly extending bearing members secured to the outer surface of each inner section.

26. The apparatus of claim 25 further comprising locking means carried by one of said sections and releasably engageable with the other section for restraining relative, substantially vertical movement therebetween in either direction.

* * * * *

UNITED STATES PATENT AND TRADEMARK OFFICE

CERTIFICATE OF CORRECTION

PATENT NO 3,967,458

DATED : July 6, 1976

INVENTOR(S) : Ralph E. Scales

It is certified that error appears in the above-identified patent and that said Letters Patent are hereby corrected as shown below:

Col. 2, line 32, "along the line 12-of Fig. 3" should read --along the line 12-12 of Fig. 3--.

Col. 4, line 22, "slot" should be --slots--.

Col. 5, line 6, the following phrase is omitted "69 of the frame member 16 and the buoyancy compartments" should be inserted after "buoyancy compartments".

Col. 7, line 24, "engaged" should be --engage--.

Col. 8, line 17, "pins" should read --pin--.

Col. 9, line 7, subparagraph (d) "lowe ends" should read --lower ends--.

Col. 9, claim 7, line 38, "handling" should read --holding--.

Col. 9, claim 10, line 52, "member means" should read --member and means--.

Col. 11, claim 23, subparagraph (c), line 18, "siad" should read --said--.

Signed and Sealed this

Ninth Day of November 1976

[SEAL]

*Attest:*

RUTH C. MASON
*Attesting Officer*

C. MARSHALL DANN
*Commissioner of Patents and Trademarks*